United States Patent [19]

Braginetz

[11] Patent Number: 4,592,186

[45] Date of Patent: Jun. 3, 1986

[54] HEAVY DUTY ANCHOR FOR DECK BOARDS AND THE LIKE

[75] Inventor: Paul A. Braginetz, Staunton, Va.

[73] Assignees: B. P. Fishburne, Jr., Washington, D.C.; Marlin G. Wilson, Staunton, Va.

[21] Appl. No.: 760,468

[22] Filed: Jul. 30, 1985

[51] Int. Cl.[4] ..... E04B 1/38

[52] U.S. Cl. ..... 52/699; 52/715; 403/396; 403/400

[58] Field of Search ..... 52/485, 665, 699, 712, 52/713, 714, 202, 715; 403/232.1, 394, 231, 395, 396, 399, 400

[56] References Cited

U.S. PATENT DOCUMENTS

| | | | |
|---|---|---|---|
| 789,894 | 5/1905 | Williams | 403/396 X |
| 828,616 | 8/1906 | Louden | 403/394 |
| 963,585 | 7/1910 | Kimball | 403/231 |
| 2,181,885 | 12/1939 | Goldsmith | 403/594 |
| 3,440,791 | 4/1969 | Troutner | 52/712 X |
| 3,535,751 | 10/1970 | Batchelor | 403/395 |
| 4,527,375 | 7/1985 | Braginetz | 52/715 |

FOREIGN PATENT DOCUMENTS

| | | | |
|---|---|---|---|
| 2303979 | 10/1976 | France | 403/395 |
| 163601 | 5/1921 | United Kingdom | 403/390 |

*Primary Examiner*—Carl D. Friedman
*Assistant Examiner*—Creighton Smith
*Attorney, Agent, or Firm*—B. P. Fishburne, Jr.

[57] ABSTRACT

An anchor for deck boards resting on a truss includes a deck board hold-down element, a truss-engaging resistance element and a threaded adjustable connector between the hold-down element and the resistance element.

11 Claims, 11 Drawing Figures

HEAVY DUTY ANCHOR FOR DECK BOARDS AND THE LIKE

BACKGROUND OF THE INVENTION

The present invention relates to heavy duty anchors for deck boards. In a more general way, the present invention relates to a rigid connector for perpendicular crossing structural members disposed in two right angular planes.

U.S. Pat. No. 4,527,375, issued to Paul A. Braginetz, on July 9, 1985, discloses a unitized deck board anchor bracket which spans the abutting end portions of deck boards which rest on an underlying truss. Depending arms of the anchor bracket straddle the vertical faces of the truss and are attached thereto by nailing.

The present invention is an improvement on the bracket of the prior Braginetz patent in that it is capable of exerting a far greater holding force on the deck board ends causing them to seat positively on the top edge face of the supporting truss. The deck board anchor according to the present invention, compared to the prior patented bracket, is much more suitable for heavy duty applications where a greater connecting force between crossing structural members is required.

A further feature of the present invention which is absent in the prior art is that the deck board anchor is adjustable by the action of threaded adjusting means.

Another feature of the present invention constituting an advance over the prior art is that elements of the anchor are in positive engagement with the deck boards and truss being held or secured by the anchor.

Other features and objects of the invention will become apparent to those skilled in the art during the course of the following detailed description.

DETAILED DESCRIPTION

Figure 1:
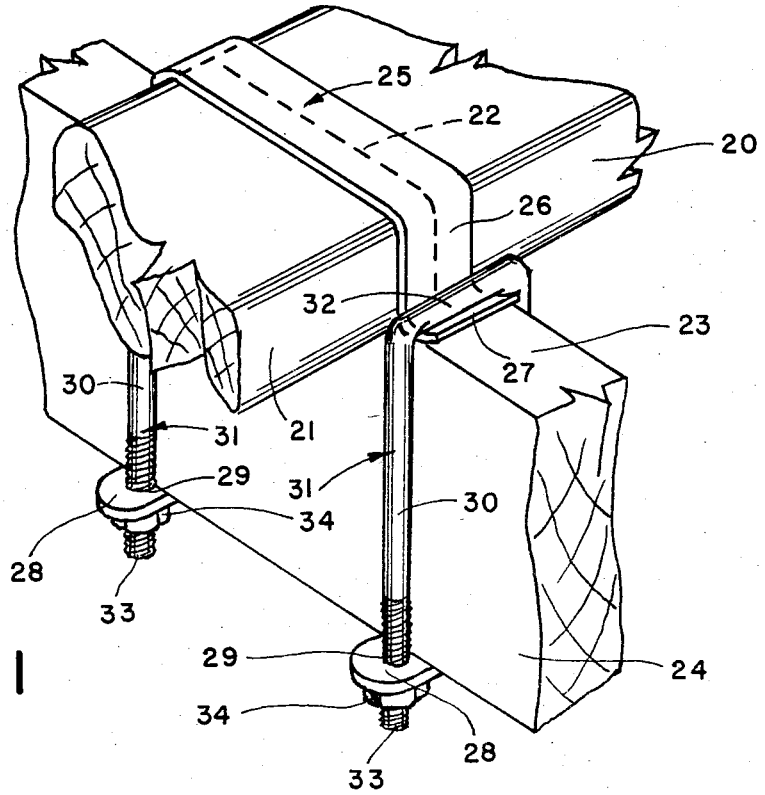
FIG. 1 is a perspective view of a deck board anchor according to one preferred embodiment of the invention.
Figure 2:
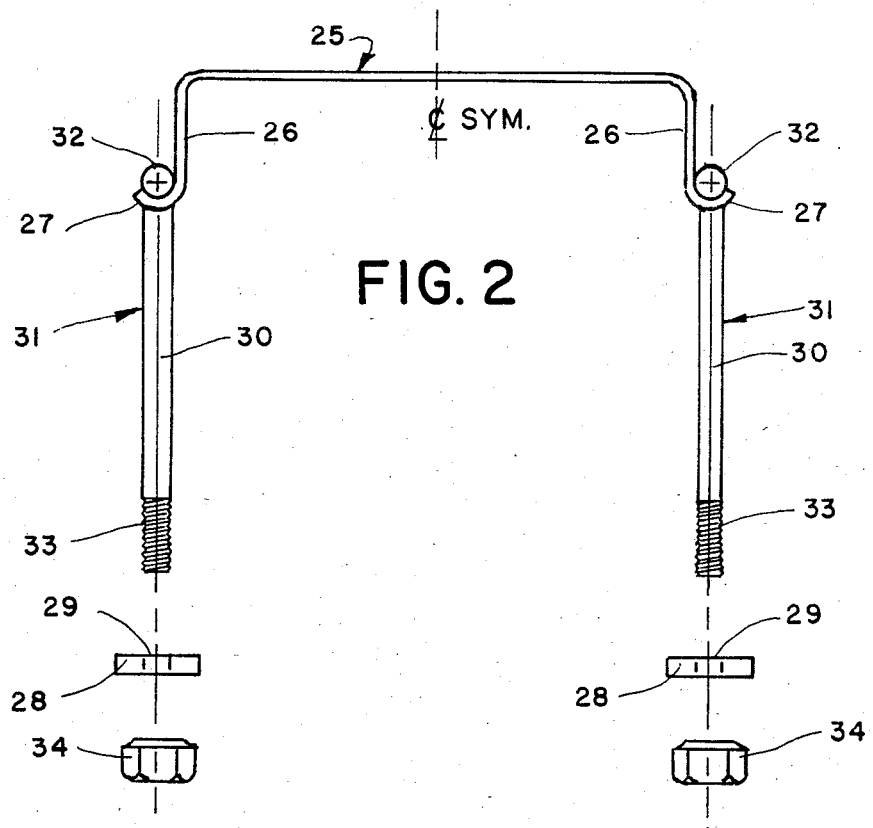
FIG. 2 is an exploded side elevation of the anchor.

Referring to the drawings in detail wherein like numerals designate like parts, FIGS. 1 and 2 of the drawings illustrate an anchor for deck boards 20 and 21 whose abutting end faces 22 rest on the top face 23 of an underlying truss 24.

The anchor comprises a deck board hold-down element or strap 25 formed of galvanized metal or the like which spans the opposing end portions of the two deck boards 20 and 21 transversely thereof and covers the end faces 22. The hold-down strap 25 has opposite end depending extensions 26 at right angles to the body portion of the strap, these extensions terminating at their lower ends in curved knuckles 27 which are located near the top face 23. Beneath the bottom face of the truss 24 in positive engagement therewith are a pair of resistance plates 28 or elements which extend across the truss bottom face and somewhat beyond its two side faces, as shown. The resistance plates 28 have apertures 29 formed therethrough near their opposite ends and adjacent to the truss side faces, and these apertures receive the vertical arms 30 of a pair of inverted U-shaped connectors 31 whose upper bight portions 32 are seated in the knuckles 27 of the deck board hold-down strap 25. The ends of the arms 30 have screw-threads 33 which receive nuts 34 below the resistance plates 28. This arrangement renders the deck board anchor adjustable and allows it to exert a heavy connecting force on both the deck boards 20 and 21 and the truss 23. The anchor as shown in FIG. 1 circumscribes the truss 23 as well as the end portions of the two deck boards 20 and 21.

Figure 3:
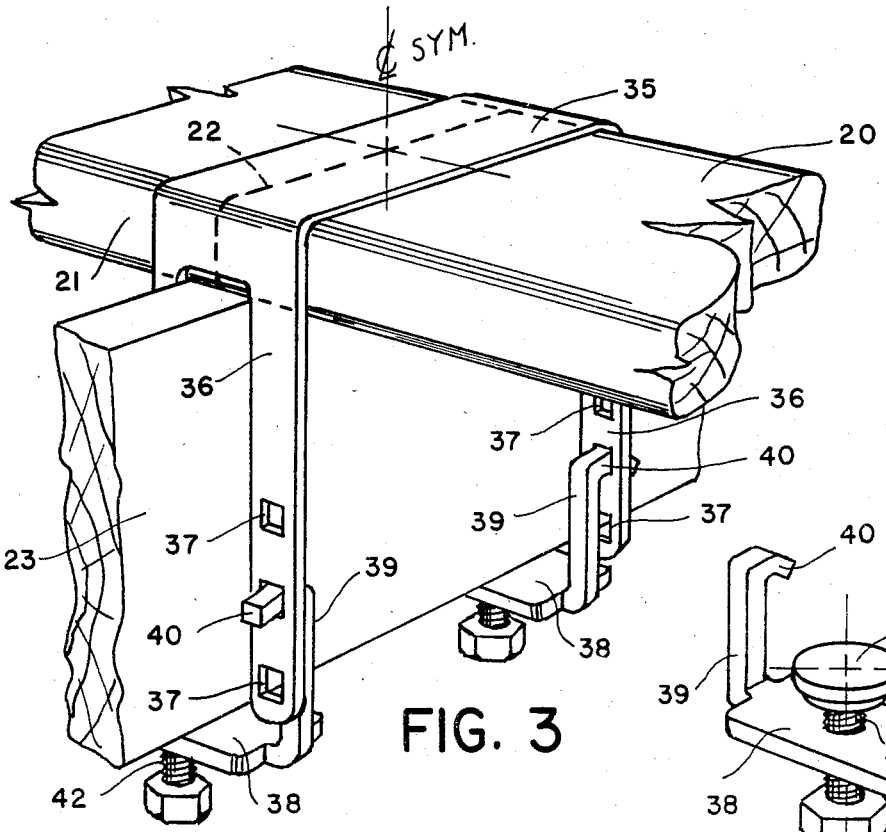
FIG. 3 is a perspective view of a deck board anchor in accordance with a second embodiment of the invention.
Figure 4:
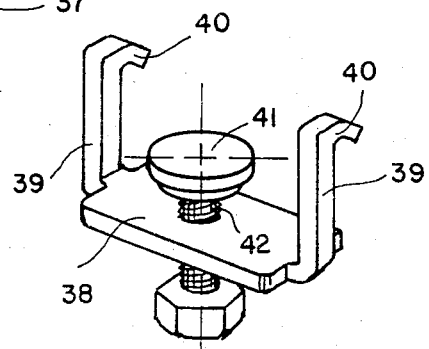
FIG. 4 is a perspective view of a truss engaging resistance element.

FIGS. 3 and 4 show an embodiment of the invention in which a deck board hold-down strap 35 includes descending arms 36 which straddle the two side faces of the truss 23. The knuckles 27 are eliminated. The arms 36 have spaced apertures 37 formed therethrough. A resistance element in the form of a plate 38 having opposite side upstanding arms 39 spans the bottom of the truss 23 in spaced relationship therewith between each pair of arms 36. Top hook terminals 40 on the arms 39 are engaged through selected apertures 37, depending on the depth of the truss 23. The discs 41 of pressure-applying screws 42, threadedly engaged with the plates 38 centrally thereof, apply heavy pressure to the bottom face of the truss 23, thus assuring that the anchor exerts heavy connecting forces on the deck boards and truss, both of which are fully circumscribed by the anchor but are not penetrated thereby.

Figure 5:
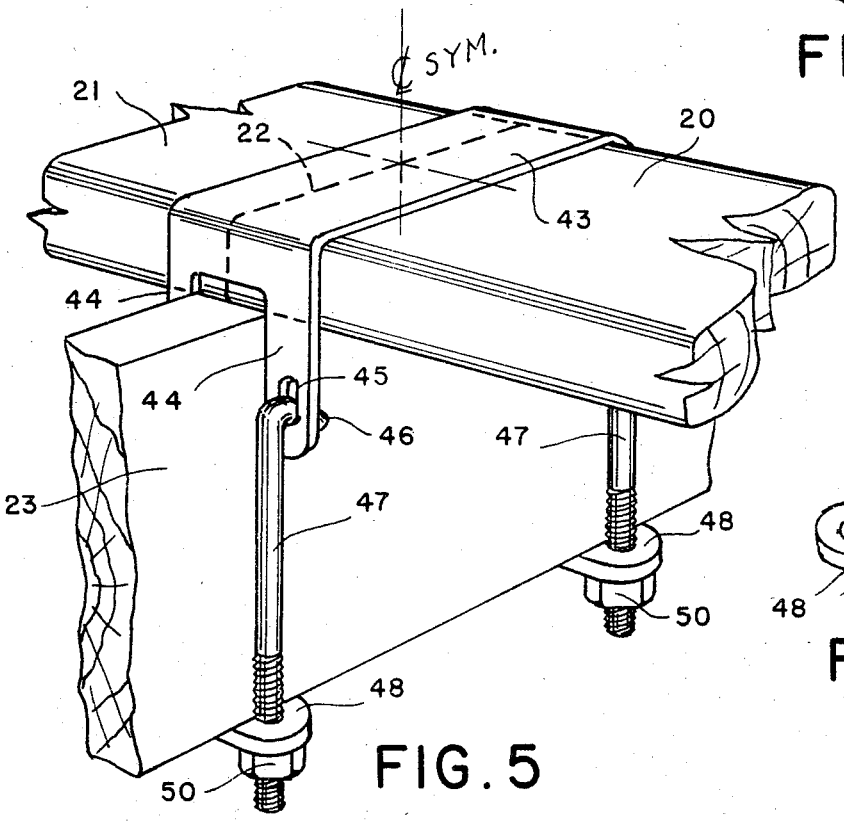
FIG. 5 is a perspective view of a third embodiment of the invention.
Figure 6:
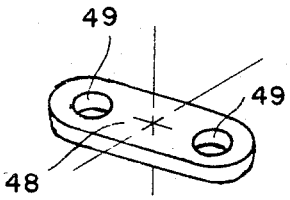
FIG. 6 is a perspective view of a truss engaging resistance element employed in the anchor according to FIG. 5.

FIGS. 5 and 6 show an embodiment of the invention in which a deck board hold-down strap 43 has foreshortened opposite end descending arms 44 which straddle the truss 23 and have apertures 45. These apertures receive therethrough hook terminals 46 of threaded connector rods 47 disposed on opposite sides of the truss 23 and extending somewhat below its bottom face. Apertured resistance plates 48 engage the bottom face of the truss 23 and receive the connector rods 47 through their apertures 49. Nuts 50 on the threaded rods 47 beneath the resistance plates 48 assure the application of heavy connecting or holding pressure on the deck boards and truss. In the embodiment of the invention shown in FIG. 3, the threaded adjustable connector means is embodied in the arms 39 and pressure-applying screws 42.

Figure 7:
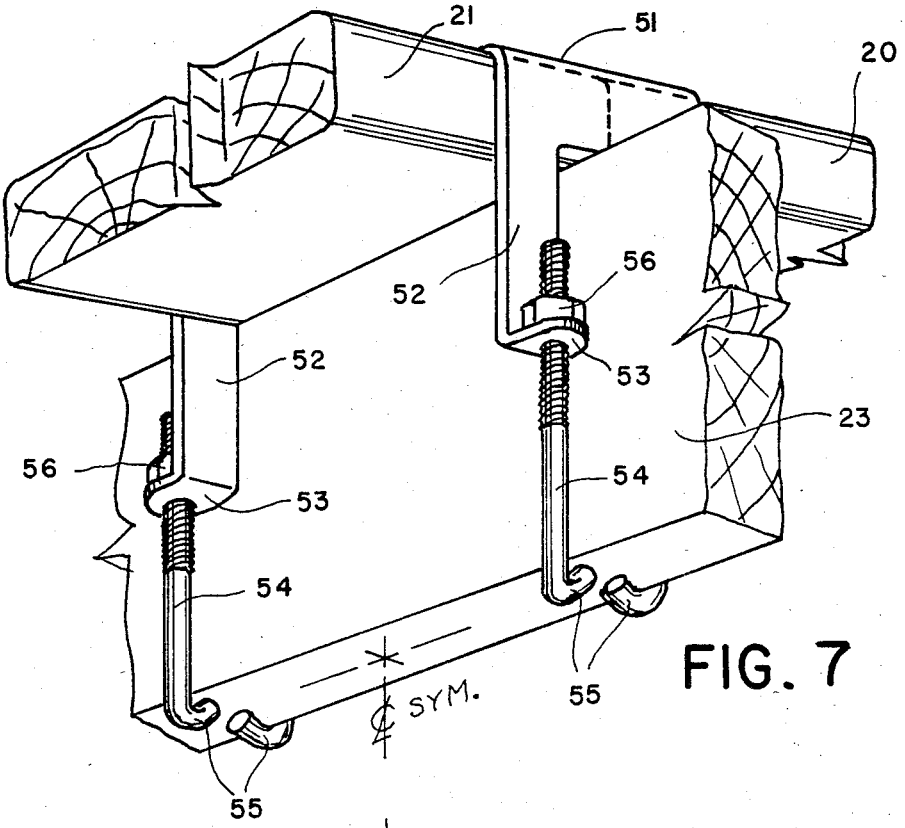
FIG. 7 is a perspective view of a deck board anchor according to another embodiment of the invention.

FIG. 7 shows an embodiment of the invention in which a deck board hold-down strap 51 includes opposite end descending arms 52 which straddle the truss 23 and have lower right angular apertured extensions 53 receiving therethrough threaded adjustable connector rods 54 having lower end hook terminals 55 which extend under the bottom face of the truss. Nuts 56 on the threaded rods 54 above the extensions 53 assure the application of heavy holding forces by the anchor. In this instance, the anchor does not completely circumscribe the truss 23, due to the spaced relationship of the terminals 55.

Figure 8:
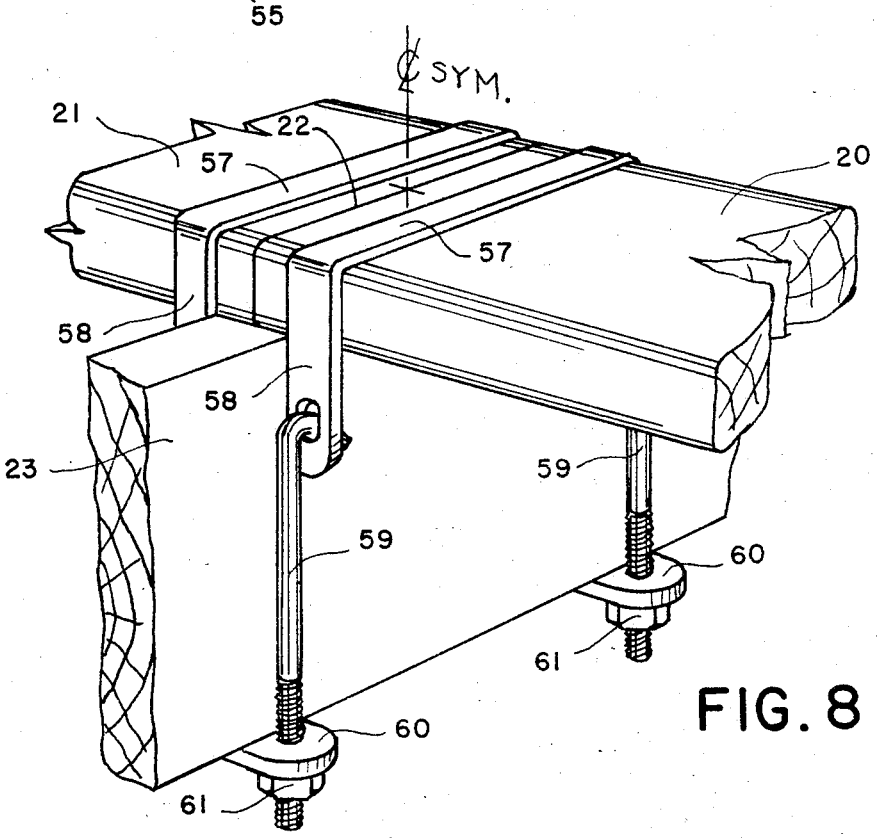
FIG. 8 is a similar view showing a further embodiment of the invention.

In the embodiment shown in FIG. 8, a pair of separated deck boards hold-down straps 57 include apertured descending arms 58 in straddling relationship with the truss 23. Threaded connector rods 59 on opposite sides of the truss extend through apertures of resistance plates 60 disposed beneath the truss and across its bottom face. Nuts 61 on the threaded portions of the rods 59 complete the anchor which circumscribes the deck boards and truss and applies heavy connecting or holding pressure thereto.

Figure 9:
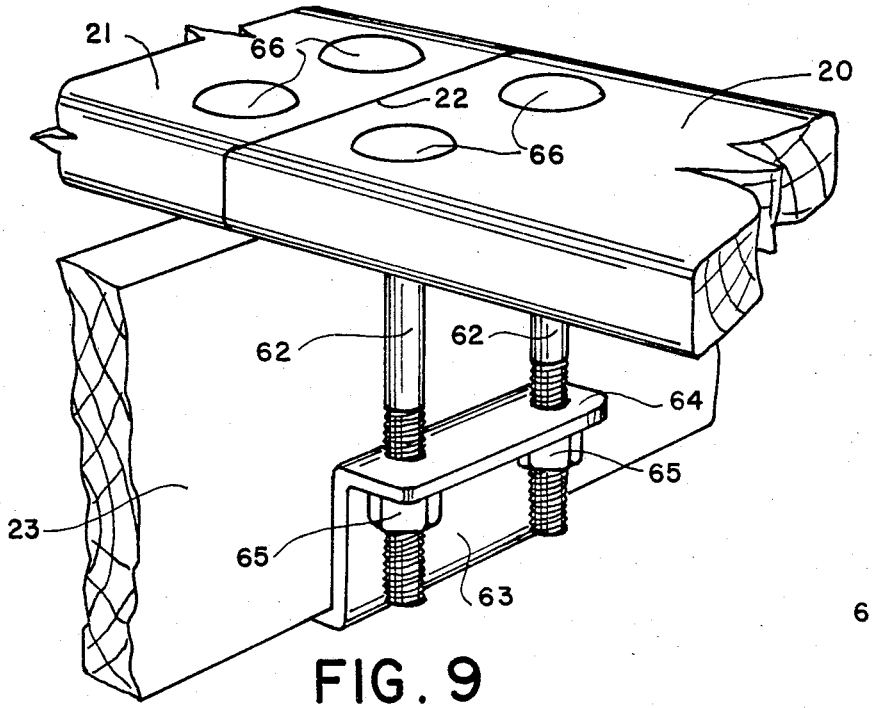
FIG. 9 is a similar view of a deck board anchor according to another embodiment of the invention.
Figure 10:
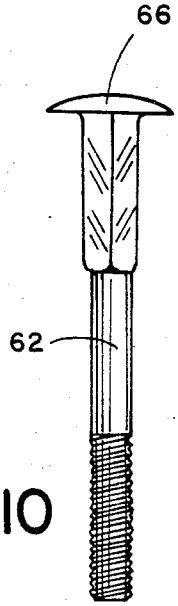
FIG. 10 is a side elevation of a deck board hold-down bolt forming an element of the anchor shown in FIG. 9.

FIGS. 9 and 10 show an embodiment of the invention in which deck board hold-down bolts 62 penetrate the end portions of the deck boards 20 and 21 and lie on opposite sides of the truss 23. A U-shaped resistance bracket 63 engages beneath the truss 23 and has apertured flanges 64 on its opposite sides projecting outwardly of the truss side faces, at right angles thereto. The apertures of the flanges 64 receive the threaded portions of the bolts 62, which carry nuts 65 below and bearing on the bottom faces of the flanges 64. In this embodiment, the anchor does not completely circumscribe the deck boards 20 and 21 but heads 66 of the hold-down bolts are sufficiently wide to resist any upward movement of the ends of the deck boards.

Figure 11:
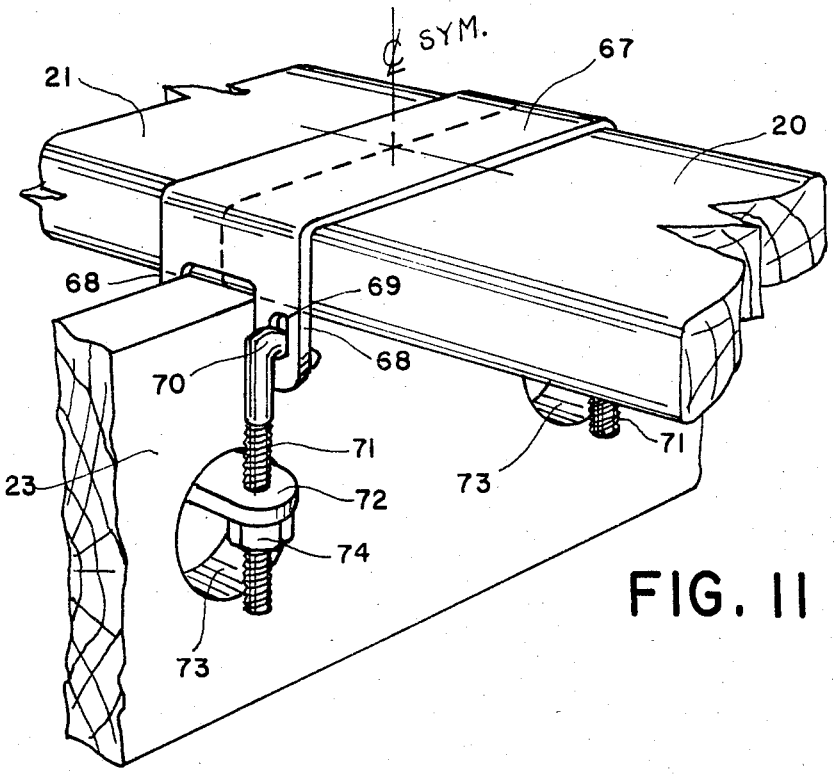
FIG. 11 is a perspective view of a deck board anchor according to still another embodiment of the invention.

In FIG. 11, a deck board hold-down strap 67 has descending arms 68 which have apertures 69 receiving hook terminals 70 of threaded connector rods 71. Resistance plates 72 extend through openings 73 of the truss 23 and engage the upper edge portions of these openings when nuts 74 on the threaded rods 71 below the resistance plates 72 are tightened. The arrangement in FIG. 11 is advantageous when very deep trusses up to 12" or more are encountered. The arrangement does require drilling holes through the truss.

It can now be seen that each embodiment of the invention above-described is adjustable by screw-threaded means and is capable of applying heavy holding or anchoring forces on the deck boards 20 and 21 and truss 23. Each embodiment of the invention includes a deck board hold-down element positively engaging the deck board, an opposing or resistance element positively engaging the truss, and an adjustable threaded connector between the hold-down element and the resistance element.

While the drawings show the deck board hold-down straps or elements spanning the meeting end portions of deck boards 20 and 21, it should be understood that the invention is in no sense limited to this particular application. The hold-down straps or elements may be applied to a deck board at any location therealong where a truss 23 happens to underlie the board, the trusses being located on regular centers of 18" or the like. The anchors can also be installed at the edge of a deck where a deck board terminates above a truss.

It is to be understood that the forms of the invention herewith shown and described are to be taken as preferred examples of the same, and that various changes in the shape, size and arrangement of parts may be resorted to, without departing from the spirit of the invention or scope of the subjoined claims.

I claim:

1. A deck board anchor for deck boards having substantially abutting end portions resting on a truss beneath the deck boards comprising a deck board hold-down means adapted to positively engage the top faces of deck board end portions, a resistance means adapted to positively engage a truss supporting deck boards, a threaded adjustable connector means between said hold-down means and said resistance means and being operable to cause the hold-down means and resistance means to simultaneously exert forces on the deck boards and truss supporting deck boards to draw such elements together in anchored relationship, said deck board hold-down means comprising a strap means adapted to span deck board end portions transversely and having descending elements at the opposite ends thereof, said threaded adjustable connector means being positively engaged with said descending elements, said descending elements comprising spaced descending arms adapted to straddle a truss supporting deck boards, and said threaded adjustable connector means including spaced pairs of connector elements positively engaged with said arms.

2. A deck board anchor as defined in claim 1 and said deck board anchor circumscribing deck board end portions and having parts passing through openings in a truss supporting deck boards.

3. A deck board anchor as defined in claim 1, and said deck board hold-down means comprising a strap member engageable above and across deck board end portions and having apertured descending arms at the opposite ends thereof adapted to straddle a truss underlying and supporting deck board end portions, and said resistance means including a resistance plate adapted to be placed under a truss supporting deck board end portions, said threaded adjustable connector means comprising a pressure screw threadedly engaged with said plate and adapted to apply pressure to the bottom of a truss, and ascending arms on said plate having hook terminals positively engaging through selected apertures of the descending arms of the strap member.

4. A deck board anchor as defined in claim 1, and the deck board hold-down means comprising a strap member across the top faces of substantially abutting deck board end portions and having opposite end descending apertured arms adapted to straddle a truss beneath deck board end portions, said resistance means comprising a pair of apertured resistance plates beneath a truss supporting deck board end portions, and said threaded adjustable connector means comprising pairs of threaded connector rods having hook terminals at corresponding ends thereof engageable through the apertures of said descending arms, and nuts on the threaded rods below and engaging said resistance plates.

5. A deck board anchor as defined in claim 4, and said strap member comprising a pair of separated strap sections on opposite sides of substantially abutting end faces of deck boards to which the anchor is applied, and each strap section at its opposite ends carrying a pair of said descending apertured arms adapted to straddle a truss.

6. A deck board anchor as defined in claim 1, and said deck board hold-down means comprising a strap across the top of deck board end portions and having opposite end descending arms adapted to straddle a truss below deck board end portions, said arms having substantially right angular apertured extensions, said threaded adjustable connector means comprising pairs of threaded rods received through the apertures of said extensions and nuts on the threaded rods above said extensions, and said resistance means comprising lateral extensions on the lower ends of the threaded rods adapted to positively engage the bottom face of a truss supporting deck board end portions.

7. A deck board anchor as defined in claim 1, and said deck board hold-down means comprising a strap engageable across the top faces of deck board end portions and having opposite end short descending apertured arms adapted to straddle a truss below deck board end portions, said resistance means comprising a pair of apertured resistance plates adapted to extend through openings formed in a truss, and said threaded adjustable connector means comprising pairs of threaded connector rods received through the apertures of the resistance plates and carrying nuts below the resistance plates and having lateral terminals at corresponding ends engaging through the apertures of said descending arms.

8. A deck board anchor for deck boards having substantially abutting end portions resting on a truss beneath the deck boards comprising a deck board hold-down means adapted to positively engage the top faces of deck board end portions, a resistance means adapted to positively engage a truss supporting deck boards, a threaded adjustable connector means between said hold-down means and said resistance means and being operable to cause the hold-down means and resistance means to simultaneously exert forces on deck boards and a truss supporting deck boards to draw such elements together in anchored relationship, said deck board hold-down means including bolt heads bearing on the top surfaces of deck board end portions, and said threaded adjustable connector means comprising pairs of threaded bolt shanks adapted to straddle a truss supporting deck boards.

9. A deck board anchor as defined in claim 8, and said resistance means comprising a bracket adapted to extend beneath a truss supporting deck boards and having opposite end apertured flanges receiving said threaded bolt shanks through the apertures thereof, and nuts on the threaded bolt shanks below said flanges.

10. A deck board anchor for deck boards having substantially abutting end portions resting on a truss beneath the deck boards comprising a deck board hold-down means adapted to positively engage the top faces of deck board end portions, a resistance means adapted to positively engage a truss supporting deck boards, a threaded adjustable connector means between said hold-down means and said resistance means and being operable to cause the hold-down means and resistance means to simultaneously exert forces on deck boards and a truss supporting deck boards to draw such elements together in anchored relationship, said deck board hold-down means comprising a hold-down strap adapted to be placed over substantially abutting deck board end portions and having descending end portions terminating in knuckles, said threaded adjustable connector means comprising a pair of inverted generally U-shaped connectors having arms adapted to straddle a truss supporting deck boards and having bight portions seated in said knuckles, and said resistance means comprising a pair of apertured resistance plates adapted to lie beneath a truss supporting deck boards and receiving said arms through the apertures thereof.

11. A deck broad anchor as defined in claim 10, and said arms being threaded, and nut on said thread arms and engaging the bottoms of said apertured resistance plates.

* * * * *